United States Patent [19]

Sakurada et al.

[11] 4,414,545

[45] Nov. 8, 1983

[54] MEMORY CIRCUIT FOR GENERATING LIQUID CRYSTAL DISPLAY CHARACTERS

[75] Inventors: Hiroshi Sakurada; Naofumi Aoyama, both of Mobara, Japan

[73] Assignee: Hitachi, Ltd., Tokyo, Japan

[21] Appl. No.: 329,047

[22] Filed: Dec. 9, 1981

[30] Foreign Application Priority Data

Dec. 17, 1980 [JP] Japan ..... 55-177271

[51] Int. Cl.[3] ..... G09G 3/36

[52] U.S. Cl. ..... 340/790; 340/784; 340/735

[58] Field of Search ..... 340/745, 784, 750, 735, 340/790

[56] References Cited

U.S. PATENT DOCUMENTS

| | | | |
|---|---|---|---|
| 3,778,810 | 12/1973 | Hayashi | 340/735 |
| 3,996,584 | 12/1976 | Plager | 340/745 |
| 4,122,533 | 10/1978 | Kubinak | 340/790 |
| 4,283,724 | 8/1981 | Edwards | 340/790 |

*Primary Examiner*—Marshall M. Curtis

*Attorney, Agent, or Firm*—Antonelli, Terry & Wands

[57] ABSTRACT

A liquid crystal display character generator circuit comprises a first RAM for temporarily storing information to be displayed on a liquid crystal display unit, a ROM for storing standard character patterns corresponding to the information to be displayed, a second RAM operable to store special character patterns corresponding to the information to be displayed, and a data selector for enabling the designation of an address in one of the ROM and the second RAM in accordance with the information stored in the first RAM.

2 Claims, 3 Drawing Figures

MEMORY CIRCUIT FOR GENERATING LIQUID CRYSTAL DISPLAY CHARACTERS

This invention relates to a liquid crystal display character generator circuit formed of one chip integrated circuit which is suitable for display of information on a liquid crystal display unit in the form of a letter, symbol or figure.

The prior art and the present invention as well as the advantages of the latter will be described in detail with reference to the accompanying drawings, in which.

Figure 1:
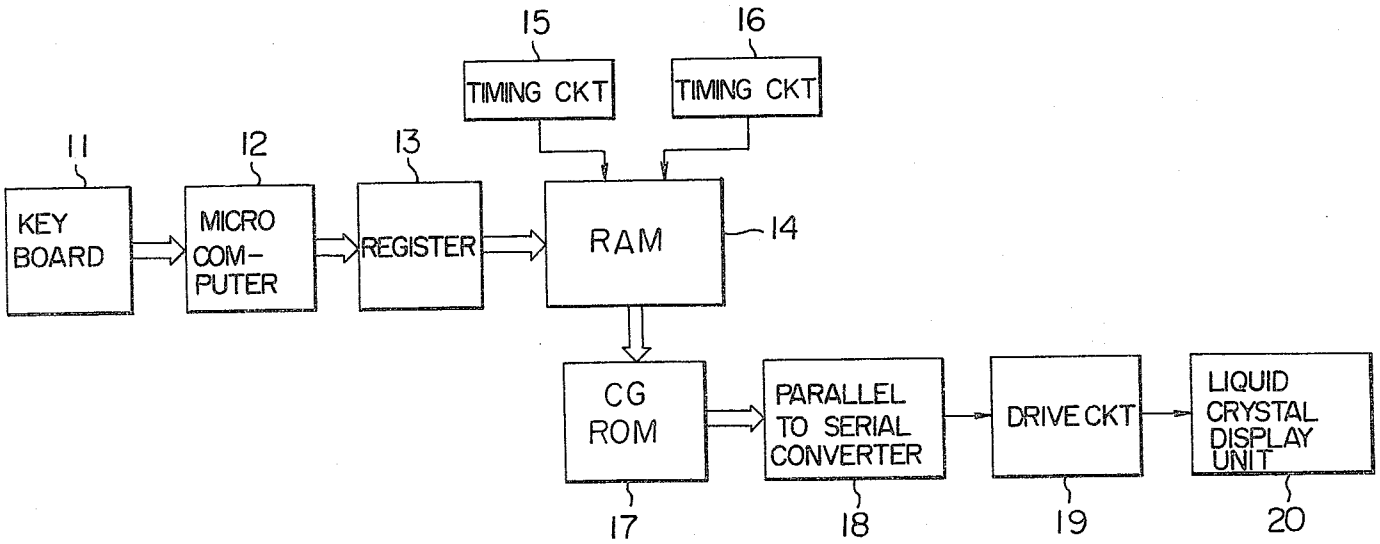
FIG. 1 is a block diagram showing an example of a liquid crystal display system.

Referring to FIG. 1, showing an example of a liquid crystal display system, a keyboard 11 is operated by an operator to input information to be displayed, and a microcomputer 12, which includes control logics for display operation, is adapted to encode (for example, into an ASCII code) the input information and applies the encoded information as an input data signal IPD to a register 13. A random access memory (RAM) 14 stores the contents of the input display information, i.e. what kind of letter, symbol or figure is to be displayed. The RAM 14 reads-in the contents of the encoded information from the register 13 in accordance with a timing determined by a read-in timing circuit 15 and designates an address in a character generator ROM (CGROM) 17 corresponding to the stored information in accordance with a timing determined by a read-out timing circuit 16. In respective addresses of the CGROM 17, respective patterns of letters, symbols or figures (hereinafter generally referred to as characters) necessary for actual display have previously been written, for example, in the form of a $5\times7$ dot matrix. When an address is designated by the RAM 14, a signal corresponding to a character pattern written in the designated address is delivered out of the CGROM 17. A parallel to serial converter circuit 18 is adapted to convert a parallel output signal delivered out of the CGROM 17 for every scan into a serial signal, but it may be omitted depending on the type of a subsequent drive circuit 19. The drive circuit 19 is responsive to a serial signal from the parallel to serial converter circuit 18 to display a letter, symbol or figure corresponding to the input information on a liquid crystal display unit 20. In the liquid crystal display system, the RAM 14 and the CGROM 17 constitute a character generator circuit.

In applying the liquid crystal display system to standard utilization where all kinds of information that are desired to be displayed can be displayed with use of a previously prepared ROM 17, for example, a ready-made commercially available ROM, it is relatively easy to fabricate a liquid crystal display character generator circuit by using two integrated circuits such as the RAM 14 and the ROM 17 as explained herebefore, and the employment of the two integrated circuits will not entail serious problems if the number of the generator circuits required or to be manufactured is relatively small. However, many manufacturing steps are inevitable for fabricating a character generator circuit with employment of the two integrated circuits for the RAM 14 and ROM 17, even though commercially standardized integrated circuits may be used for the RAM 14 and ROM 17, and therefore, with a large number of character generator circuits to be manufactured, the employment of two integrated circuits is not advantageous. But, it is usual to employ two separate integrated circuits for the RAM 14 and ROM 17 forming the character generator circuit, because of difficulty of estimating the number of character generator circuits to be manufactured for the market.

Figure 2:
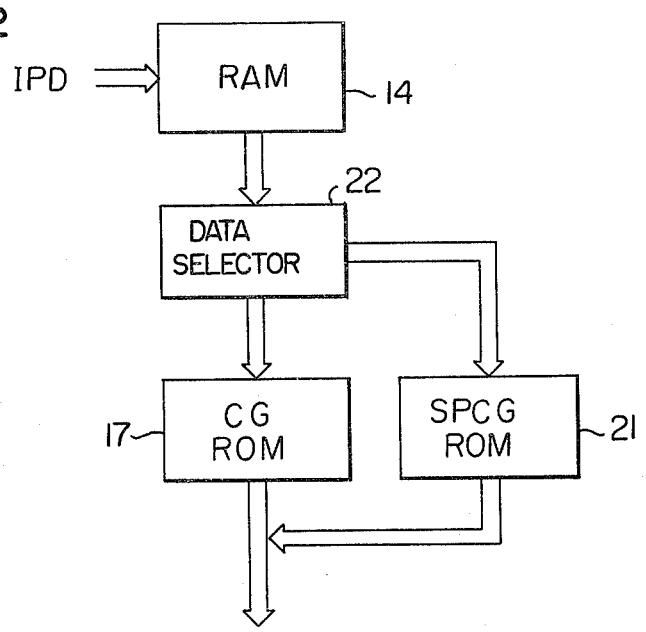
FIG. 2 is a block diagram showing a prior art liquid crystal display character generator circuit.

On the other hand, display of a special symbol, figure or latter not included in the standard ROM is sometimes demanded by the user. In such a case, it has hitherto been common practice to use an additional, special character generator ROM (SPCGROM) 21 as shown in FIG. 2, dedicated to the special symbol, figure or letter. More particularly, special letters, symbols or figures as demanded by the user have previously been stored in the SPCGROM 21, and an address in the CGROM17 or an address in the SPCGROM 21 corresponding to the information stored in the RAM 14 is selectively designated by a data selector or multiplexer 22. In response to a ROM selecting signal generated from the control logics or in accordance with logical processing of a signal representative of the information stored in the RAM 14, the data selector 22 selects one of the CGROM 17 and the SPCGROM 21. The user is accessible to the SPCGROM 21 by specially ordering a mask ROM or preparing a programmable ROM. In case where the contents stored in the ROM 21 are sometimes desired to be changed, the use of the mask ROM is unsuitable and the programmable ROM such as of a FAMOS or SAMOS is employed. In the latter case, however, there is required equipments and special tools for reprogramming the contents to be stored. In addition, the additional connection of the ROM 21 is time consuming because the integrated circuit has in general a great number of terminals.

It is therefore an object of the present invention to provide a liquid crystal display character generator circuit which can eliminate the aforementioned disadvantages.

To accomplish the above object, according to the invention, a liquid crystal display character generator circuit comprises at least three unitary components integrated in a one chip integrated circuit, of which a first RAM component is adapted to store information to be displayed, a ROM component in which patterns necessary for display of standard letters, symbols or figures corresponding to the information have been written beforehand, and a second RAM component independent of the first RAM component and adapted to store special character patterns which were stored in the externally connected SPCGROM 21 in the prior art character generator circuit.

The first and second RAM components are formed on the same chip, but the second RAM component is operable entirely independent of the first RAM component. Accordingly, the number of terminals is increased as compared with the number of terminals owned by of a single RAM of a memory capacity equal to the sum of memory capacities of the first and second RAM's. Such an increase in the terminal number, however, is not serious in practical applications embodying the invention.

Figure 3:
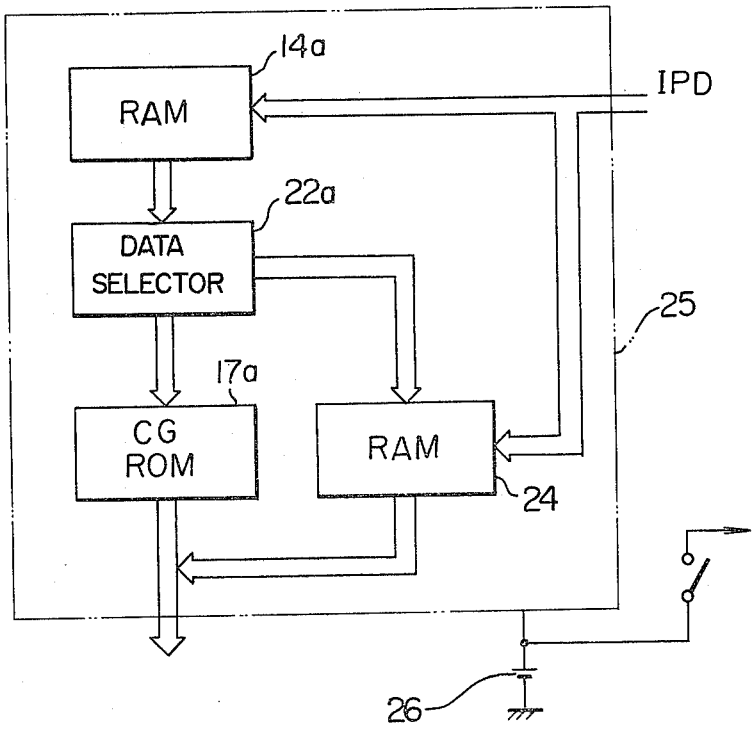
FIG. 3 is a block diagram showing a liquid crystal display character generator circuit embodying the present invention.

Referring now to FIG. 3, there is shown a preferred embodiment of a liquid crystal display character generator circuit according to the invention. The character generator circuit comprises an integrated circuit in which a first RAM component 14*a*, a ROM component 17*a* and a second RAM component 24 are integrated on a single chip 25. Patterns of special characters demanded by the user are stored in respective addresses in the second RAM component 24, in the form of a 5×7 dot matrix for example, as in the SPCGROM 21 shown in FIG. 2. These special characters can be written in the RAM 24 by operating the keyboard 11 or using data for the special character patterns inserted in part of the user's program. When writing, the input data signal IPD contains the data for the special character patterns and the writing of the data into the second RAM 24 is instructed by a signal from the control logics. Standard character patterns are stored, for a standard use of the system, in the CGROM 17*a*, as in the CGROM 17 of FIG. 2.

When displaying, encoded display information data are contained in the input data signal IPD and contents of the information are stored in the RAM 14*a*. The data selector 22*a* selects one of the CGROM 17*a* and RAM 24 in accordance with the logical processing of a signal representative of the information stored in the RAM 14*a*. For example, when all of the upper four digits of the ASCII code are zero, the RAM 24 is selected and an address in the RAM 24 corresponding to the information stored in the RAM 14*a* is designated. Following the address designation, a signal corresponding to a character pattern stored in the designated address is delivered from the RAM 24, and the drive circuit 19 drives the display unit 20 to display thereon a letter, symbol or figure corresponding to the input display information. A similar operation proceeds when an address in the CGROM 17*a* is designated.

When it is desired to change the special character pattern stored in the second RAM 24, such change can be effected by displaying the original pattern on the display unit 20 and writing a changed pattern into the RAM 24 through operation of the keyboard 11 while monitoring the displayed pattern, or it may be effected by changing the character data in the user's program. In this manner, the change of the character pattern can completely be accomplished by a software without resort to any special tools.

Since the RAM is a volatile memory, it is necessary to prevent volatilization of the stored contents upon interruption of power supply. To this end, a battery power source 26 is provided as shown in FIG. 3 to set up a battery backup structure. However, when the special character pattern is written into the RAM 24 by using the character data inserted in part of the user's program, the writing into the RAM 24 is carried out each time the system is operated so that no problems are encountered in the use of the volatile RAM 24 for the special character pattern storage, thus eliminating the necessity of the battery backup structure.

In a case where the special character patterns are not required or the number of the required special character patterns is small, the second RAM 24 as a whole or in part may not be dedicated to the character pattern storage, but may be used for a temporary storage of information, like the first RAM 14*a*.

In this embodiment, the RAM 24 substituting for the SPCGROM 21 separately prepared and added in the conventional circuit is formed in a one chip integrated circuit for the following reasons. Conventionally, general consideration was such that a majority of kinds of special character pattern are demanded by the user and a large capacity memory is required to store the special character patterns. Practically, however, the number of special character patterns demanded by the user was found not so large. And, because of the easy change of the character pattern as described above, selective storage of only frequently demanded special character patterns was proven satisfactory. Consequently, it was confirmed that a small memory capacity is satisfactory and a drastic increase in the chip size is unnecessary. Secondly, the writing of the character patterns into the RAM 24 and the change of the character patterns can be accomplished freely by the user through a software and the RAM 24 applicable to other utilizations than the storage of the special character patterns can enjoy versatility in use.

As has been described, since the RAM 14*a*, CGROM 17*a*, RAM 24 and data selector 22*a* constituting the character generator circuit are integrated in the one chip integrated circuit, easy fabrication and compact formation of the character generator circuit can be assured. And, although the integrated circuit per se is expensive, the character generator circuit of the invention can be fabricated at a lower cost than the prior art character generator circuit with the externally added SPCGROM 21. Further, in contrast to such general practice that a ROM is not formed of a CMOS because of requirement for high speed operation, all of the RAM 14*a*, CGROM 17*a* and RAM 24 can be formed of CMOS on a single chip since a liquid crystal display system does not require high speed operation. For these reasons, the character generator circuit of this embodiment can advantageously reduce power consumption as compared with the prior art character generator circuit constituted by separate RAM 14, CGROM 17 and SPCGROM 21. Moreover, the character generator circuit of this embodiment has versatility in use because of using the RAM 24, thereby ensuring its mass production and low cost production.

What is claimed is:

1. A liquid crystal display character generator circuit comprising:

a first RAM for temporarily storing information to be displayed on a liquid crystal display unit;

a ROM for storing in its respective addresses standard character patterns corresponding to information to be displayed and producing, when one of the addresses is designated, a signal representative of a character pattern stored in the designated address;

a second RAM capable of being dedicated for storing in at least one of its addresses at least one special character pattern corresponding to information to be displayed and operable to produce, when the address is designated, a signal representative of the character pattern stored in the designated address; and a data selector for selecting one of the ROM and the second RAM in accordance with contents of the information stored in the first RAM and enabling the designation of the address in the selected one of the ROM and the second RAM in accordance with the information stored in the first RAM, said first RAM, ROM, second RAM and data selector being integrated in a one chip integrated circuit.

2. A character generator circuit according to claim 1 which further comprises a battery power source always connected with the circuit.

* * * * *